United States Patent [19]

Minegishi

[11] 3,994,657

[45] Nov. 30, 1976

[54] FACTORY APPARATUS FOR PRODUCING CONCRETE MEMBERS

[75] Inventor: Koichi Minegishi, Tama, Japan

[73] Assignee: Nihon Kogen Concrete Kabushiki Kaisha, Tokyo, Japan

[22] Filed: Feb. 25, 1975

[21] Appl. No.: 553,042

[30] Foreign Application Priority Data

June 12, 1974 Japan ..... 49-67395

[52] U.S. Cl. ..... 425/404; 425/88; 425/429; 425/432; 425/455 R; 425/456

[51] Int. Cl.[2] ..... B28B 5/04

[58] Field of Search ..... 425/88, 404, 429, 430, 425/432, 445–446, 453–456, DIG. 200–DIG. 201; 198/127 R; 259/2

[56] References Cited

UNITED STATES PATENTS

| | | | |
|---|---|---|---|
| 2,775,787 | 1/1957 | Krag | 425/DIG. 201 |
| 3,412,439 | 11/1968 | Baker | 425/404 |
| 3,525,131 | 8/1970 | Schneider et al. | 425/88 |
| 3,568,274 | 3/1971 | Hidden et al. | 425/454 |
| 3,577,610 | 5/1971 | Margolin et al. | 425/404 |
| 3,602,963 | 9/1971 | Lingl | 425/455 |
| 3,606,633 | 9/1971 | Engelmann | 425/432 |
| 3,612,159 | 10/1971 | Galinsky | 425/455 |
| 3,739,050 | 6/1973 | Koncz et al. | 425/88 |

FOREIGN PATENTS OR APPLICATIONS

| | | | |
|---|---|---|---|
| 231,107 | 5/1963 | Austria | 425/455 |
| 1,281,349 | 10/1968 | Germany | 198/127 R |
| 1,070,164 | 6/1967 | United Kingdom | 425/446 |

*Primary Examiner*—Richard B. Lazarus
*Assistant Examiner*—John McQuade
*Attorney, Agent, or Firm*—Ladas, Parry, Von Gehr, Goldsmith & Deschamps

[57] ABSTRACT

There are disclosed a method and an apparatus for producing an elongated concrete member of a trapezoid cross section for use as a cross tie, i.e., a prestressed concrete member for fixing rails of railroads. Those methods and apparatus include in sequence, the steps of attaching end plates to a mold having an open top surface and end plates removed beforehand, said attaching operation being carried out in the condition of said mold having an open top surface and end plates removed beforehand, said attaching operation being carried out in the condition of said mold being transported in the longitudinal direction of said apparatus but lengthwise of said mold to complete the assembly of said mold, said mold being of such a construction that an elongated concrete member of a trapezoid cross section may be molded upside down; stocking said mold thus assembled in the transversely transportable condition; placing concrete into said mold, stamping and vibrating same; curing said concrete thus placed in said mold, transporting in the longitudinal direction of said apparatus said mold containing said elongated concrete member which has completed curing; removing said elongated concrete member from said mold; finishing said elongated concrete member thus removed; and returning said empty mold to an assembly.

8 Claims, 14 Drawing Figures

FACTORY APPARATUS FOR PRODUCING CONCRETE MEMBERS

BACKGROUND OF THE INVENTION

This invention relates to an apparatus for producing elongated concrete member of a trapezoid cross section for use as a cross tie, i.e., a prestressed concrete member for railroad rails.

In general, it is mandatory for automatically producing prestressed concrete members to automate the assembly of molds, the transportation of the molds after assembly and the removal of concrete members from molds. Hitherto, automatic removal of the concrete members from molds have not be attained so that the aforesaid steps associated therewith are carried out separately, rather than automatically.

SUMMARY OF THE INVENTION

It is the first object of the present invention to provide an apparatus for producing an elongated concrete member of a trapezoid cross section, wherein the transportation of a mold is carried out cyclically and automatically within a minimized space.

It is the second object of the present invention to provide an apparatus for producing an elongated concrete member of a trapezoid cross section, in which the respective steps of the production, particularly placing concrete and removal of the cured concrete member are effected automatically.

It is the third object of the present invention to provide an apparatus for producing an elongated concrete member in which the concrete member may be produced accurately and which presents mold well accommodating the production of such an elongated concrete member.

According to the present invention, there is provided an apparatus for producing an elongated concrete member, which apparatus is used in a method including, in sequence, the steps of attaching end plates to a mold having an open top surface and end plates removed beforehand, said attaching operation being carried out in the condition of said mold being transported in the longitudinal direction of said apparatus but lengthwise of said mold to complete the assembly of said mold, said mold being of such a construction that an elongateed concrete member of a trapezoid cross section may be molded upside down; stocking said mold thus assembled in the transversely transportable condition; placing concrete into said mold, stamping and vibrating same; curing said concrete thus placed in said mold; transporting in the longitudinal direction of said apparatus said mold containing said elongated concrete member which has completed curing; removing said elongated concrete member from said mold; finishing said elongated concrete member thus removed; and returning said empty mold to an assembly.

BRIEF DESCRIPTION OF THE DRAWINGS

FIG. 3 and 4 are front and perspective views respectively of a concrete placing, vibrating and stamping device while

FIGS. 6 and 7 being taken along the lines VI—VI and VII—VII respectively of FIG. 8 and FIG. 8 being taken along the line VIII—VIII of FIG. 7;

DESCRIPTION OF THE PREFERRED EMBODIMENTS

In this specification, the term 'longitudinal' or 'transversely', when simply used, is meant by the longitudinal or transverse direction of the apparatus for producing an elongated concrete member, unless otherwise specified.

Figure 1:
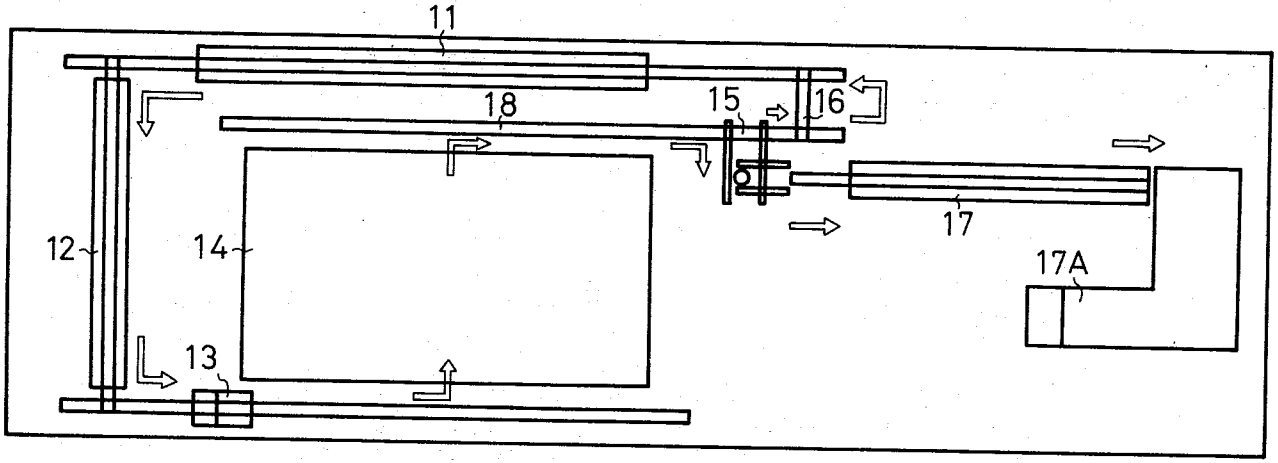
FIG. 1 is a plan view of the lay-out of a cross tie producing apparatus.

FIG. 1 shows the layout of a production apparatus for use in producing a prestressed concrete member such as a cross tie. This apparatus comprises: an assembly line 11, in which molds P (not shown) are assembled in the longitudinally transporting condition but lengthwise there of; a back line 12, in which assembled molds P are stocked in the transversely transportable condition; a concrete placing line 13, in which concrete is placed or poured in molds P in the longitudinally transporting condition, then vibrated and stamped; the concrete placing line 13 forming a 'U' shape together with the lines 11 and 12; a curing area 14 defined between the parallel lines 11 and 13; a concrete-member member removing line incorporating a removing device 15 located on the side of assembling the molds in the line 11; a return device 16 for returning the empty molds from the removing device 15 to the assembly line 11. The concrete members removed from molds by the removing device 15 are finished in a finishing line 17. Shown at 17A is a temporary stock area of the concrete members.

Figure 2:
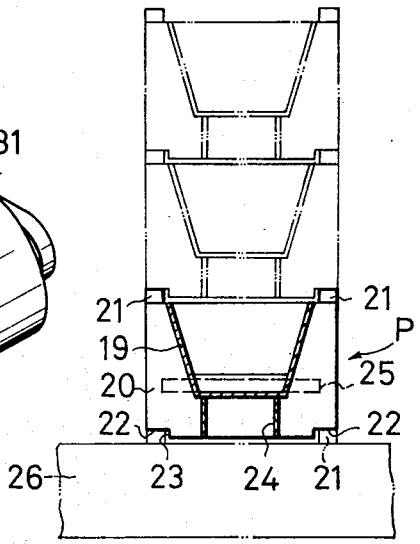
FIG. 2 is a transverse cross section view of a mold taken along a section line near the end of the mold.

With this apparatus, molds P are assembled in the line 11, then stocked in the line 12, and in turn transported to the line 13, wherein concrete is placed in molds P, while being subjected to vibration and stamping operations, and then the molds are transported to the predetermined positions in curing area 14. Then, the molds P in which the curing of placed concrete has been completed are transported along the transportation path 18 running between the curing area 14 and the line 11 in the longitudinal direction but lengthwise thereof and eventually intermittently fed to a concrete-member removing device 15. The opposite end plates of the mold P are removed within the curing area 14 or on the transporting path 18. Subsequently, cross tie members Q (not shown) thus removed from molds in the removing device are fed to a finishing line 17, where a prestress is introduced therein, followed by finishing, after which the membrs Q are arranged in order in a temporary stock area 17A. On the other hand, the molds P, from which are removed cross tie members Q, are transversely transported by way of a returning device 16 to the starting end of the assembly line 11, in line with the feeding of cross tie members to the finishing line 17. The feeding spacing of the cross tie members on the transportation path 18 are predetermined intermittently in a manner that the succeeding mold P will not be fed in the removing device 15, until the return device 16 is operated. The arrow marks in FIG. 1 show the directions of flow of the cross tie members Q. FIG. 2 shows the transverse cross-sectional view of molds P. Such a production apparatus has an advantage of permitting production of cross tie members in a minimized space according to the cyclic transportation of the molds. In addition, the apparatus is designed, based on the intermittent feeding of molds which feeding results from the intermittent cross tie removing operations, and permits the production of cross tie members Q automatically.

Referring to the construction of the molds P for use in such an apparatus, an elongated box type mold body 19 is made of sheets such as of iron or plastic, having an open top surface and a trapezoid shape in cross section. The mid portion of the bottom of the mold body 19 is raised so as to accommodate the shape of the cross tie member Q. The opposite end plates of the mold body 19 may be removed. The longitudinally opposite ends of the mold body 19 are provided with supporting plates 20 which are two in number and of a flange form. Provided on the top opposite edges of the supporting plates 20 are standard horizontal supports 21 for supporting the respective molds at four points, when a plurality of molds are stacked one on top of another, while there are provided cut-away portions 23 in the lower opposite edges of the supporting plate 20 to present the standard horizontal planes 22. Extending from but integrally with the bottom of a mold body 19 except for the raised bottom portion are two parallel leg plates 24 for reinforcing the longitudinal rigidity of the mold. Extending in the horizontal direction from but integrally with the raised bottom portion of the mold body 19 are two leg plates 25 extending through the center portions of the respective leg plates 24 in the widthwise direction of the mold P in projecting relation to the mold body 19. The both leg plates 25 are connected by means of connecting plates (not shown).

The mold P is mounted on a base support 26 at four points in the curing area 14, with the supporting plate 20 being mounted on the standard horizontal support 21 on the base support 26, on the standard horizontal plane 22 of the plate 20. The other molds P are mounted in stacked relation one on top of another according to a four-point supporting fashion. As a result, the entire assemblage of the molds P may settle by themselves due to the weights of molds P and concrete placed therein, even if one mold body 19 is distorted, due to the four-point supporting manner, thereby permitting the production of cross tie members Q at a high accuracy. In addition, the molds P may be transported by means of leg plates 24 in the longitudinal direction but lengthwise thereof in the mold assembly line 11, concrete placing line 13 and cross tie member removing line, while the molds P may be transported in the transverse direction in the mold bank line 12 as well as in the return line to the line 11, by means of leg plates 25.

Figure 4:
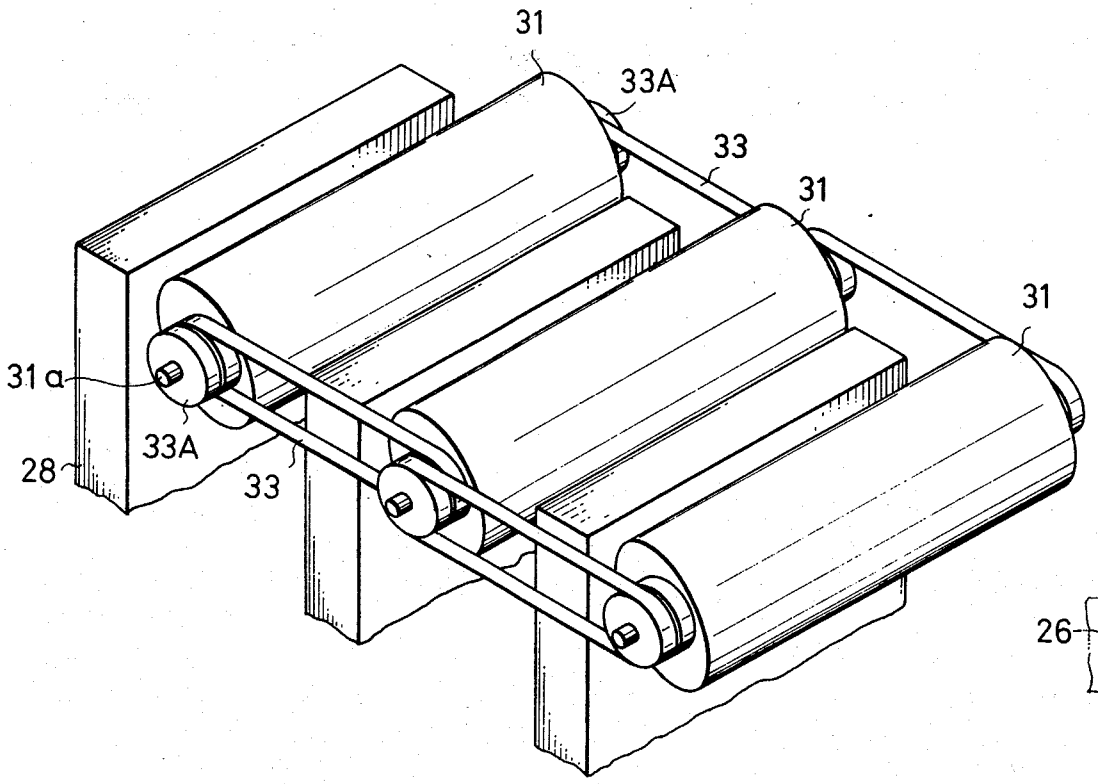
Figure 3:
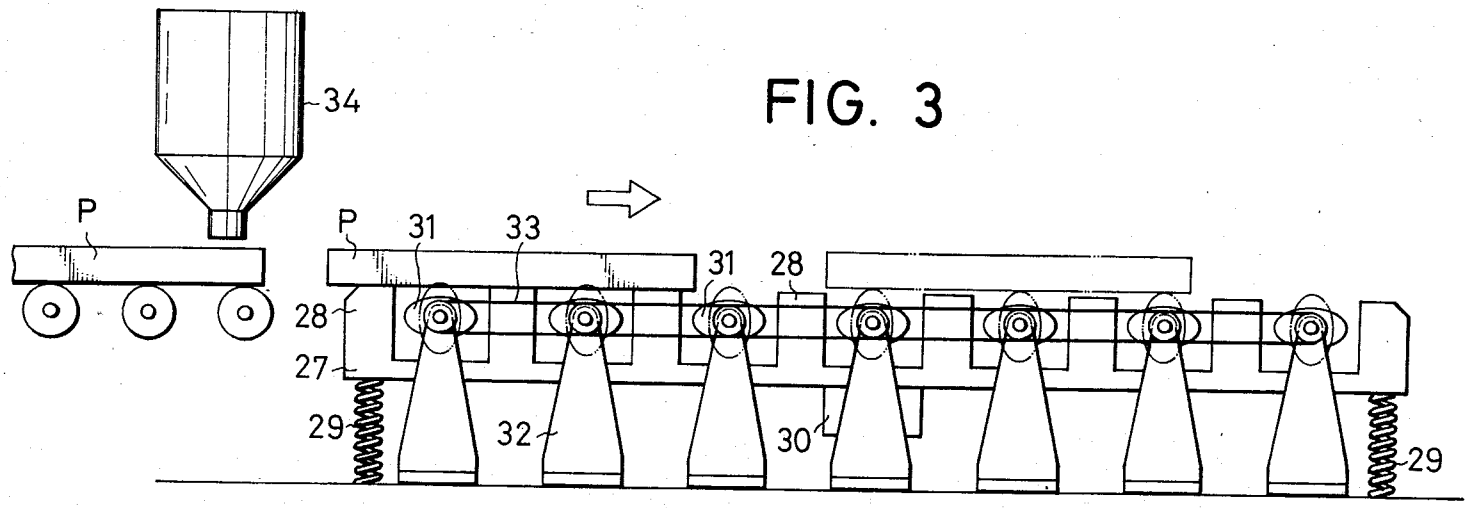

FIGS. 3 and 4 show devices for placing concrete in molds, subjected to vibration and stamping operation.

With this device, there are provided receiving supports 28 having a given spacing in the longitudinal direction of the molds P and mounted on the top surface of a vibrating base 27. The vibrating base 27 is supported by means of a springs 29 in a horizontal direction, with the top surfaces of the receiving supports 28 being in contact with the bottom of the mold P. Shown at 30 is a vibrator placed in the center, lower portion of the vibrating base 27.

Provided between the adjoining receiving supports 28 on the vibrating base 27 are feed rollers 31 of an ellipitic cross section, the rollers 31 being journaled in bearings 32 at the opposite ends of the rollers, while a shaft 31*a* of one of the feed rollers 31 is connected to a motor (not shown) having a decelerator. The respective feed rollers 31 are connected through the medium of a drive belt 33 to the other rollers 31 for simultaneous and cooperative rotation. Shown at 33A is a belt wheel provided in the feed roller portion for training the drive belt 33 around the respective feed rollers.

The relationship between the feed rollers 31 and the receiving supports 28 on the vibrating base 27 is such that, assuming the height $h$ from the axis of the roller 31 to the top edge of the receiving support 28, the shorter radius $r1$ of the feed roller 31 is smaller in dimension than the height $h$, while the longer radius $r2$ is considerably greater in dimension than the height $h$. Provided above but in the front of the vibrating base 27 as viewed in the longitudinal direction of the mold P is a concrete hopper 34 which is adapted to charge concrete into the mold P during the course of the mold being transported to the vibrating base 27.

Figure 5:
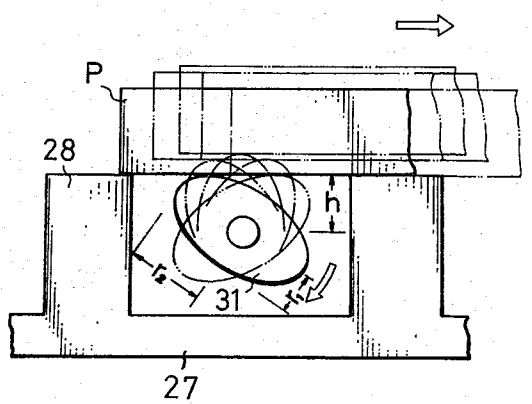
FIG. 5 is a view of part of the concrete placing, vibrating and stamping device to illustrate the operation thereof.

The molds P which is charged with concrete therein are transferred on to a plurality of receiving supports 28 on the vibrating base 27 by means of the leg plates 24. Thus, when the feed rollers 31 are rotated in the clockwise direction, then the longer radius portion projects from the mold supporting plane of the vibrating base 27 to thereby raise the mold P and cause same to advance a given distance, after which the roller surface is lowered below the mold supporting plane of the base 27 and then appears above the plane for the succeeding mold P, so that the molds P may be transported intermittently in the longitudinal direction. FIG. 5 shows the molds P being transported in the longitudinal direction.

When the vibrating base 27 is vibrated due to the vibrator in cooperation with the longitudinal transportation of the molds P, then the molds P will be vibrated, being mounted on the vibrating base 27, so that the molds P receives the vibration and the longitudinally transporting force, alternately. Thus, the placing or settlement of the concrete within molds may be carried out satisfactorily in the longitudinal transporting course, so the placing and settling operations of the concrete within molds P may be incorporated in the production efficiency.

In this respect, the degree of the settlement of the concrete within molds P may be adjusted by increasing the length of the vibrating base 27, i.e., the length of the vibrating time, while the speed of molds P being transported may be adjusted by adjusting the R.P.M. of the feed rollers 31.

Figure 8:
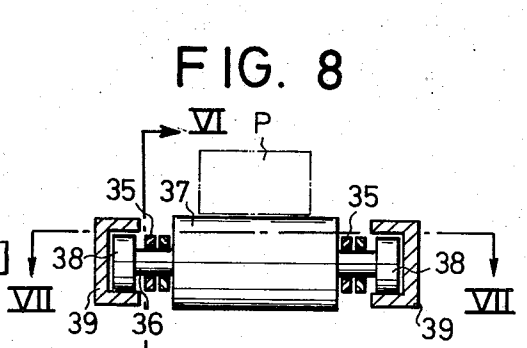
FIG. 6, 7 and 8 are respective views of a chain conveyor section on the transportation path.
Figure 6:
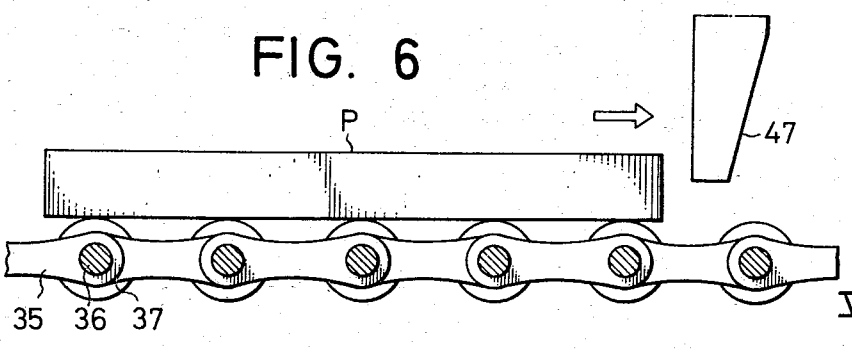
Figure 7:
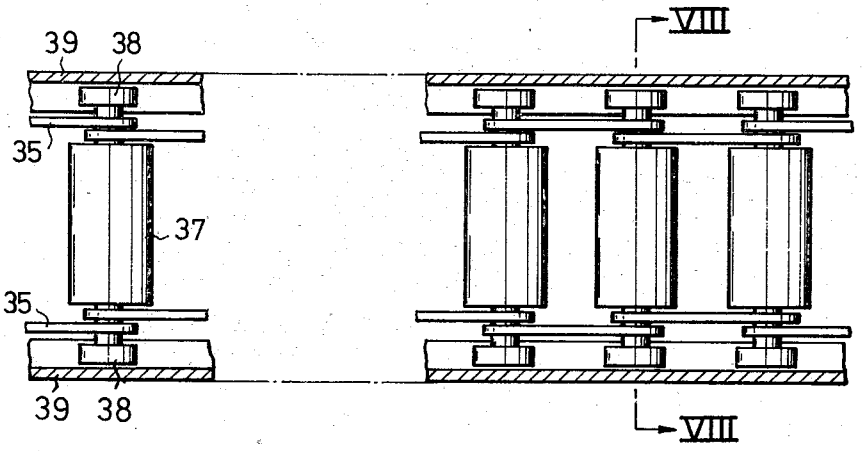

FIGS. 6, 7 and 8 show the chain conveyor section or portion of the transportation path 18.

In the conveyor portion of the transportation path, a pair of left- and right-hand chains 35 are mutually connected by means of a link shaft 36, while roller 37 is rotatably mounted on the link shaft portion between the both chains, rollers 38 being mounted thereon in a concentric relation. In addition, the rollers 38 are inserted within a pair of left- and right-hand endless guide rails 39 and supported on the rail surfaces thereof, so that the chains 35 may cause the molds P to advance in the longitudinal direction.

When the chains 35 are driven, with the molds P placed on the chain conveyor and with the leg plates 24 mounted on a plurality of rollers 37, while covering several rollers thereunder, then the molds P may be transported, being positively supported by means of rollers 38 which rolls on the rail surface of the guide rails 39. Such a longitudinal transportation of the molds P may be stopped by means of a movable stopper to be described later. At this time, the rollers 37 may continue rotate without hindering the operation of the chain conveyor.

Accordingly, only the molds P may be stopped without stopping the operation of the chain conveyor, so that the molds P may be intermittently transported to the removing device 15, as will be described hereinafter.

Figure 9:
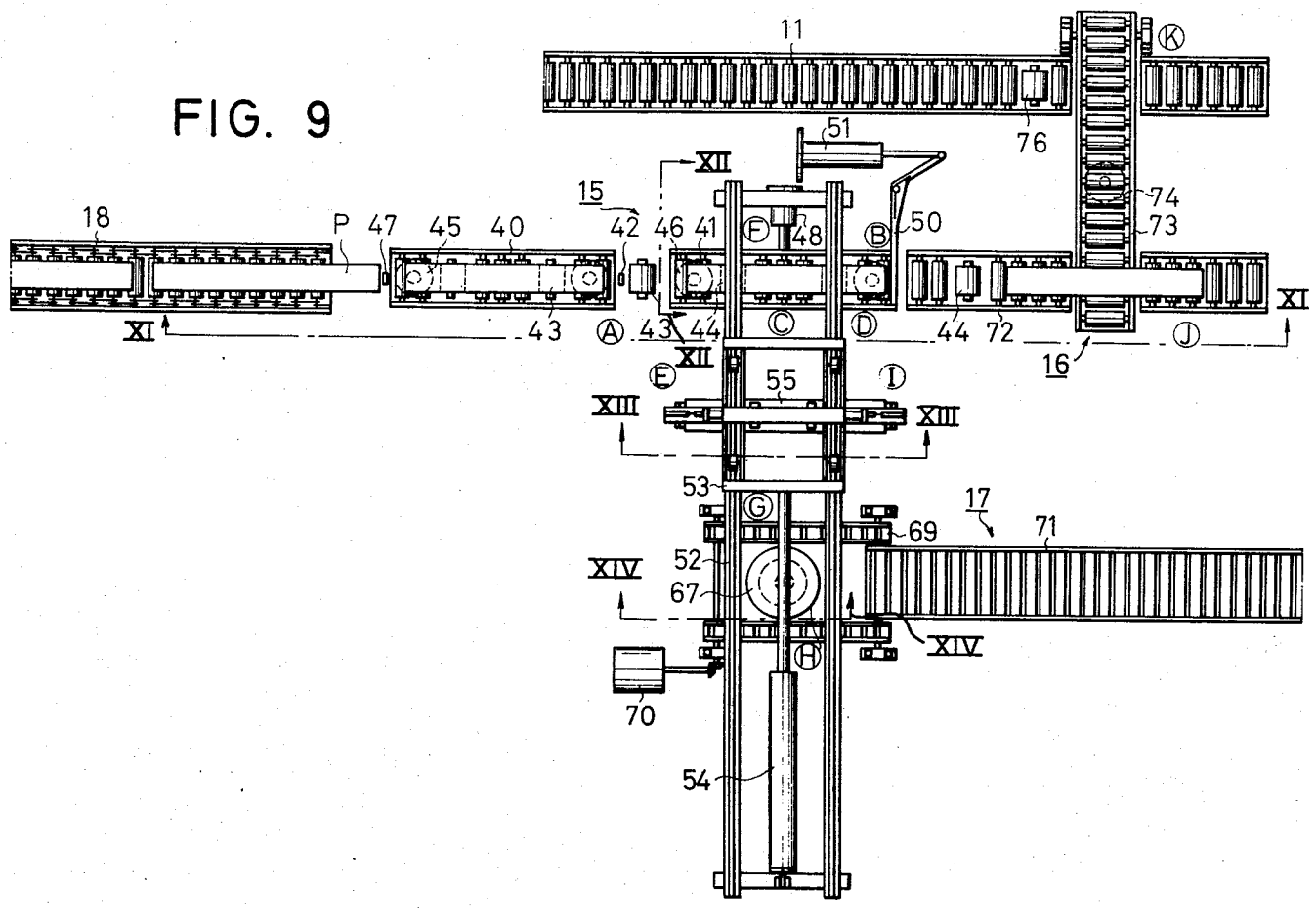
FIGS. 9 and 10 are plan and perspective views of a removing device for a concrete member from a mold and devices associated therewith.
Figure 10:
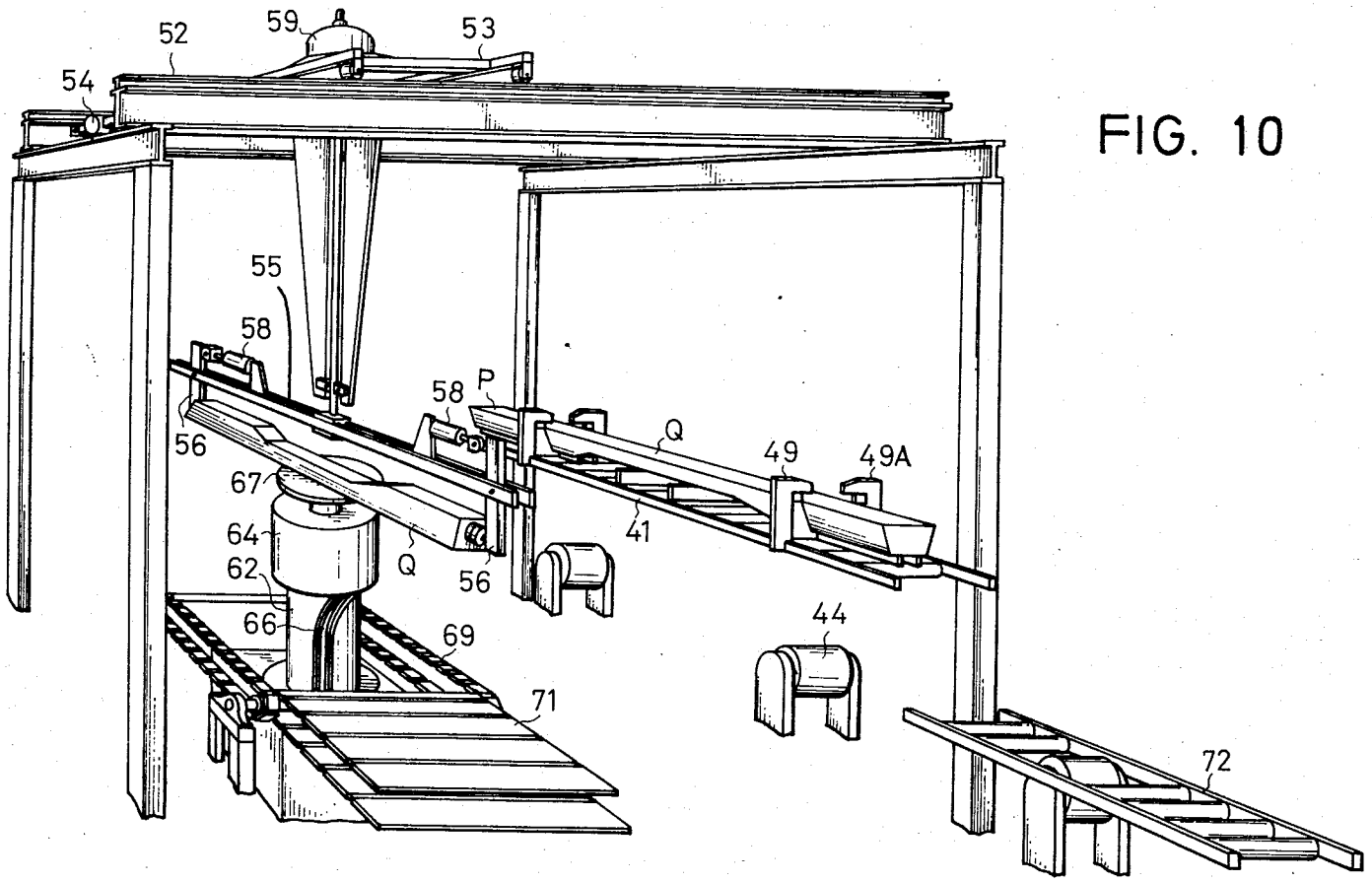

FIGS. 9 and 10 shows the outline of the relationship between the concrete-member or cross-tie-member removing device 15, a returning device 16 and a finishing line 17. Shown at A, B, C, D, E, F, G, H, I, J and K in FIG. 9 are limit switches and the positions thereof.

Figure 11:
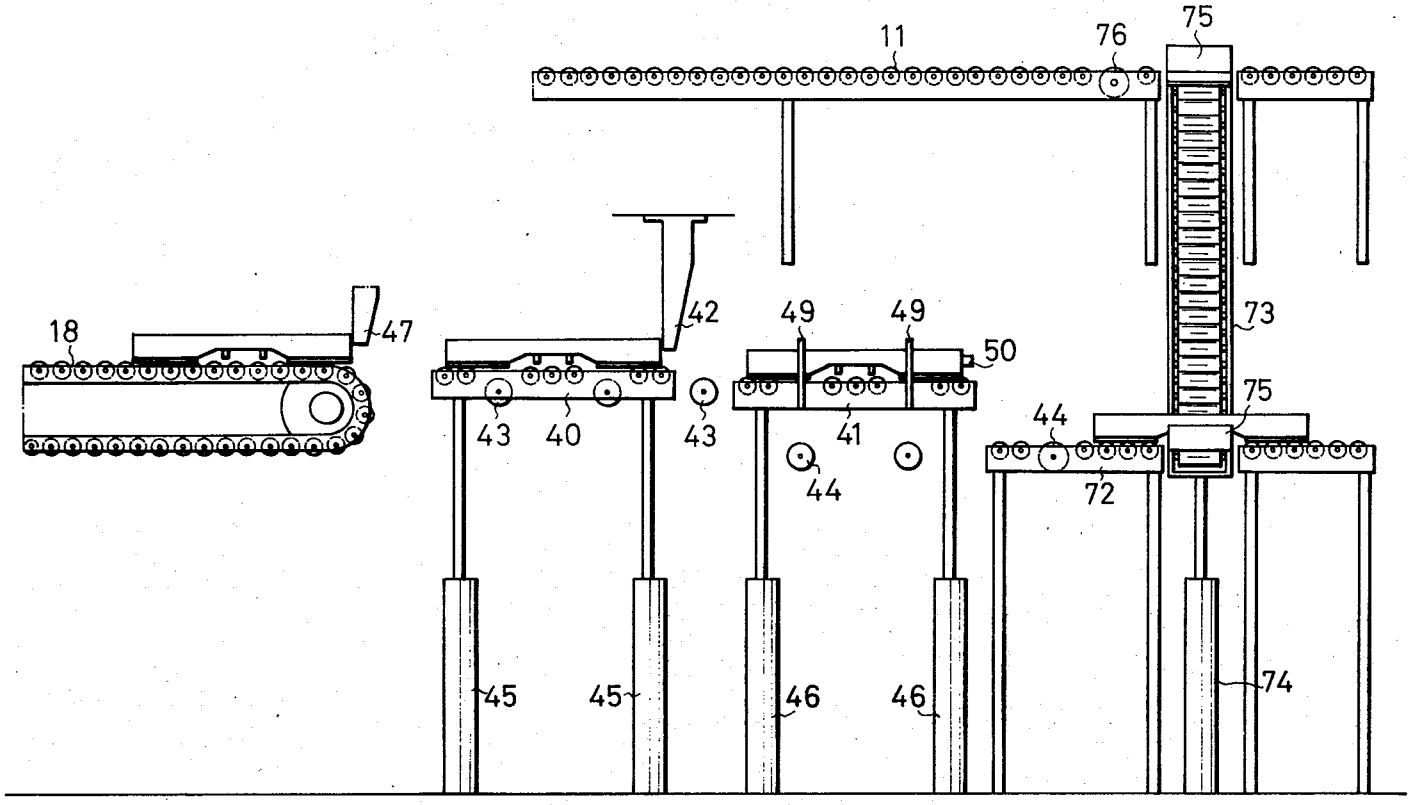
FIGS. 11, 12, 13, 14 are cross-sectional views taken along the lines XI—XI, XII—XII, XIII—XIII and XIV—XIV of FIG. 9, respectively.
Figure 12:
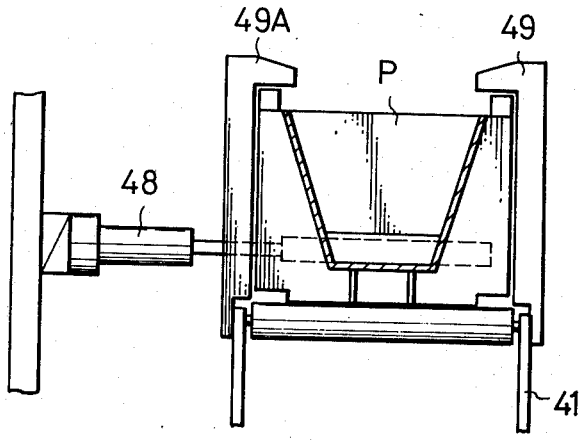

In the concrete-member removing device 15, ascending and descending portions 40, 41 are placed so as to form the front edge of the transportation path 18, while the ascending and descending portions 40, 41 may be raised or lowered, as required. A fixed stopper 42 is located between the ascending and descending portions 40, 41. A limit switch A is provided on the fixed stopper 42 above the transportation path 18. When the molds P are transported, then the limit switch A senses the arrival of the molds P, so that the ascending and descending portion 40 will be lowered to the position such that the longitudinal transportation of the molds P is not hindered by the fixed stopper 42. FIG. 11 shows the detailed arrangement of the front edge portion of the transportation path 18. In this portion, a drive roller 43 is located in the lowered position of the ascending and descending portion 40 so as to transfer the mold P, supported on the ascending and descending portion 40, onto the ascending and descending portion 41. In addition, located in the lowered position of the ascending and descending portion 41 is a drive roller 44 which is to transversely transfer the mold P, which is supported on the ascending and descending portion 41, onto the returning device 16. In this respect, the aforesaid lowered position of the ascending and descending portion 41 is further lowered from its position to receive the mold P from the ascending and descending portion 40. Either drive roller is rotated in the clockwise direction by means of a common drive source (not shown) during the operation of the cross tie producing apparatus. Shown at 45, 46 are air cylinders adapted to move up and down the ascending and descending portions 40, 41. Designated 47 is a movable stopper which may move up and down between the chain conveyor portion and the ascending and descending portion 40. The stopper 47 is so designed as to move upwards, after the returning of the ascending and descending portion 40 to its upper portion or prior to the downwards movement of the ascending and descending portion 40 initiated by the limit switch A sensing the arrival of the succeeding mold P, and then to return to its lower position. FIG. 12 shows the outline of means for determining the position of the mold in the widthwise direction thereof, the means being located in the ascending and descending portion 41. This means consists of a horizontal air cylinder 48 on the ascending and descending portion 41 on the side of the mold assembly line 11, and a hook portion 49 located on the side of the ascending and descending portion 41 in an attempt to stop the mold P which is being urged by means of the air cylinder 48. The hook portion 49 is the counterpart of the hook portion 49A provided on the other side of the ascending and descending portion 41, thereby preventing the mold P from being raised together with the cross tie member, when the latter is removed from the mold P.

On the other hand, there is provided guide plate on the hook portions 49 and 49A on the entering side of the mold P, so that the supporting plates 20 for the mold P will not interfere with the longitudinal transportation of the molds. Provided in the front of the ascending and descending portion 41 is a means for determining the position of the mold lengthwise thereof, i.e., a movable stopper 50 which may be retracted or withdrawn towards the line 11 by means of air cylinder 51 located between the ascending and descending portion 41 and the mold assembly line 11. A limit switch B is provided on the movable switch 50 and senses the arrival of a mold P transported from the ascending and descending portion 40, whereupon the air cylinder 48 is actuated to cause a piston rod to abut the connecting plate of the two leg plates 25, so that the mold P is urged against the hook portion 49. This determines the widthwise position of the mold P and actuates the air cylinder 50 to retract the movable stopper 50 towards the line 11.

Figure 13:
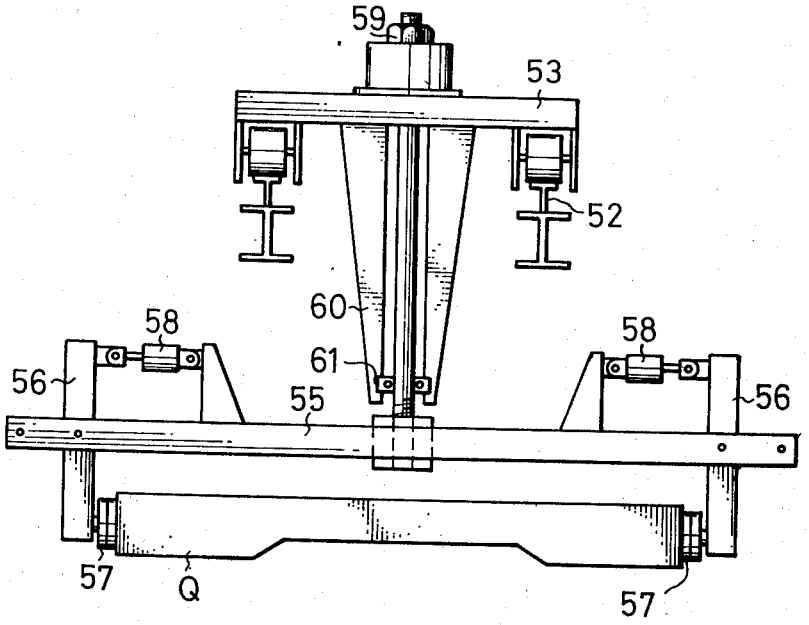

With such a transportation path 18, the molds P which have completed the curing step are transported in sequence by the chain conveyor in the longitudinal direction. Thus, when one mold P is stopped by the fixed stopper 42, then the succeeding mold P maintains the stand-by condition by means of the movable stopper 47 on the chain conveyor portion. Then, the limit switch A senses the arrival of the mold P to the ascending and descending portion 40, so that the ascending and descending portion 40 descends. As a result, the mold P advances below the fixed stopper 42 by means of the drive roller 43 to be transferred onto the ascending and descending portion 41 and then stopped by means of the movable stopper 50. Then, the limit switch B senses the arrival of the mold P, so that the air cylinder 48 is actuated, so the mold P is located accurately on the ascending and descending portion 41, with the aid of the movable stopper 50. A limit switch C is provided, for instance, on the hook portion 49 in the ascending and descending portion 41 for sensing the location of the mold P, whereby the clamps on a crane to be described are actuated or the actuation of the air cylinder 48 is released, and then the ascending and descending portion 41 ascends under the actuation of the air cylinder 45. FIG. 13 shows the detailed construction of a crane. With this crane, there are provided rails 52 located immediately above the ascending and descending portion 41 but running in the direction at a right angle to the transportation path 18, while a wheeled track 53 is reciprocably driven on the rails by means of an air cylinder 54. Suspended from the platform 53 on the rails is an inverted 'T' shaped suspension means 55 having a horizontal portion running in the transporting direction of the transportation path 18 and a vertical portion, by which is suspended the suspension means 55 from the platform 53. The suspension means 55 has clamps at its lower ends, which clamps are adapted to hold a cross tie member in the mold P longitudinally, thereof, when operated. Those clamps consist of: a pair of arms 56 which located at the opposite ends of the horizontal direction but in the rotatable relation in a vertical plane, including the horizontal portion of the suspension means 55; supporting discs 57 which are mounted on the lower opposing surfaces of the arms 56 and rotatable about the horizontal axis of the aforesaid lower opposing surfaces; and oil jacks 58 interposed between the opposing upper surfaces of the arms 56 thereon. Shown at 59 is an adjusting means for adjusting the suspension height of the cross tie member Q measured from the platform 53, i.e., the length of the vertical portion suspended from the platform 53. On the other hand, shown at 60 are supporting plates, on which are fitted guide wheels (not shown) journaled on the vertical portion of the suspension means 55. Shown at 61 are brackets having the aforesaid guide wheels journaled thereon. The limit switch D is mounted at the front edge or in the vicinity of the ascending and descending portion 41 so as to actuate the air cylinder 54 to bring the crane to the position immediately above the ascending and descending portion 41, by sensing the arrival of the forward edge of the mold P. On the other hand, a limit switch E is mounted on the clamp of crane and adapted to sense the arrival of the cross tie member Q to thereby actuate the air cylinder 46, lowering the ascending and descending portion 41. In addition, a limit switch F is located in the lowered position of the ascending and descending portion 41 and adapted to sense the downward movement of the portion 41 to thereby return the crane to its home position by means of the air cylinder 54.

Figure 14:
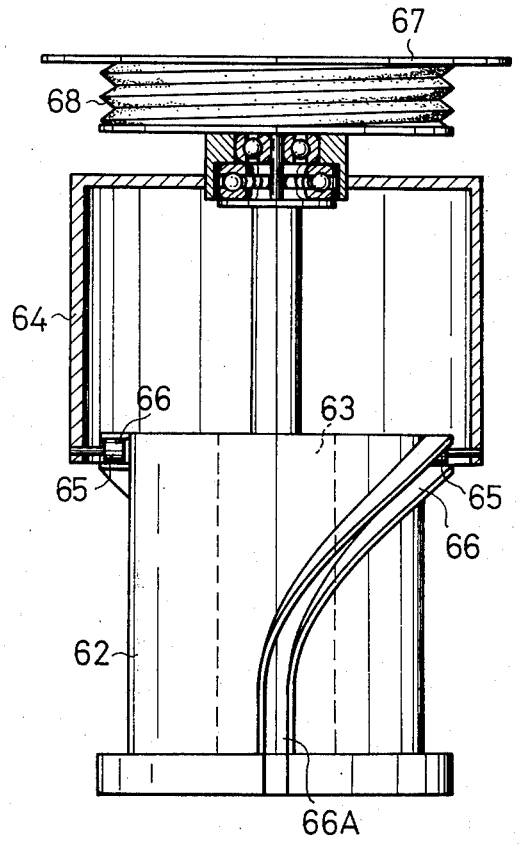

According to such a crane, when the mold P arrives on the ascending and descending portion 41 and thus located in a manner described, the air cylinder 54 is actuated by means of the limit switch D, so that the platform 53 is advanced to a position immediately above the mold P, after which, due to the limit switch C, the oil jacks 58 are actuated so that the cross tie member Q within the mold P is held between the two supporting discs 57, 57. The cross tie member Q is held due to a friction force created between the end surfaces of the cross tie member Q and the supporting discs 57. The moment the cross tie member Q is thus held, the ascending and descending portion 40 ascends to its home position, and then the movable stopper 47 ascends so that the succeeding mold P may be transferred onto the ascending and descending portion 40. Before the above transfer of the mold P, the removal of the cross tie member from the mold P, the transverse transportation of the cross tie member Q for finishing and the returning operation of the empty mold to the line 11 have been finished. The cross tie member Q may be removed from the mold P in a manner that when the limit switch E senses the arrival of the member Q, the ascending and descending portion 41 is lowered, while the mold P is held in position by means of hook portions 49, 49A. In addition due to the returning movement of the platform 53 according to the limit switch F sensing the downward movement of the ascending and descending portion 41, the cross tie member Q is transported transversely from the transportation path 18, being suspended in parallel with the longitudinal transporting direction of the mold P. During the transverse transportation, the cross tie member Q assumes a stable position presenting the cross section of a trapezoid shape, which position is rotated through an angle of 180° from a position giving an inverted trapezoid shape, which gives an instable condition to the cross tie member Q, because the center of gravity thereof is located above the position of the member Q being held. Meanwhile, the cross tie member Q removed from the mold P is then transported to the returning device by means of a drive roller 44 which is located in the lowered position of the ascending and descending portion 41. A limit switch G is positioned on the frame of a crane in the home position of the platform 53 and adapted to sense the returning movement of the platform 53 to thereby move upwards the rotating device located immediately below the aforesaid home position. FIG. 14 shows the rotating device in detail. The rotating device consists of a lower cylindrical body 62 vertically positioned in the lower part thereof and having a bottom portion, an upper cylindrical body adapted to ascend or descend due to the vertical air cylinder 63 fitted in the interior of the lower cylindrical body 62, rollers 65 rotatably located in contacting retation to the lower inner circumferential surface of the upper cylindrical body 64 inwardly thereof, and guide grooves 66 provided in the outer circumferential surface of the lower cylindrical body 62 for guiding the rollers 65, with the roller 65 being fitted in the guide grooves 66 so that the upper cylindrical body 64 may rotate in one direction or another through an angle of 90° due to the ascending and descending motions of the lower cylindrical body 62. The guide grooves 66 are formed with vertical portions 66A in the lower parts thereof, whereby the upper cylindrical body 64 is rotatingly lowered and then descends vertically. Shown at 67 is a mounting plate 67 affixed to the top of the upper cylindrical body 64. Shown at 68 is a buffer means interposed between the mounting plate 67 and the top of the upper cylindrical body 64. A limit switch 11 is mounted on the rotating device and adapted to sense the mounting plate 67 reaching its upper position to thereby actuate the oil jack 58 of the aforesaid crane, thus releasing the clamps. In this respect, the height of the cross tie member suspended is adjusted by means of the adjusting means 59 provided on the suspension means 55 of the crane commensurate with the upper stop position of the rotating device so as to permit the cross tie member Q suspended from the crane to be mounted on the rotating device. A limit switch I is provided on the oil jack 58 of the crane and adapted to sense the condition of the clamps being released due to the actuation of the jack 58, thereby actuating the air cylinder 63 to lower the mounting plate 67. According to such a rotating device, when the cross tie member held by the clamps of the crane reaches the position immediately above the rotating device due to the crane being returned, the upper cylindrical body 64 ascends under the actuation of the air cylinder 63 which has been initiated by the limit switch G, thereby rotating the mounting plate 67 through an angle of 90° to stop. At this time, the limit switch H senses the upper cylindrical body 64 being stopped in its upper position to thereby release the clamps of the crane, so that the cross tie member Q which has been held by the clamps is mounted on the mounting plate 67 having a buffer means thereunder, after which the mounting plate 67 is lowered commensurate with the downward movement of the upper cylindrical body 64 which movement has been initiated by the limit switch I sensing the releasing condition of the clamps. At this time, the upper cylindrical body 62 is rotated through an angle of 90° to descend under the guiding action of the guide grooves 66 and rollers 65, after which the body 64 descends vertically along the vertical portions 66A of the guide grooves 66. This causes the cross tie member Q on the mounting plate 67 to be rotated through an angle of 90° in the direction perpendicular to the transportation path 18, and then descends. Shown at 69 in FIG. 9 are a pair of chain conveyors. Shown at 70 is a drive motor for use with chain conveyors 69. Shown at 71 is a slat conveyor forming a finishing line 17. Since the cross tie member Q is supported by the chain conveyors 69 at its opposite ends during the linear downward movement, so that the cross tie member Q is transported in its widthwise direction, i.e., in the longitudinal direction of the line 17 in the condition suited for finishing. Particularly, the orientation of the cross tie member may be selected as required, by suitably selecting the angle of the transverse transportation of the cross tie member Q by means of the crane to the transportation path 18, as well as the angle of the mounting means consisting of the rotating means and chain conveyors 69, which means changes the direction of the cross tie member Q. On the other hand, the mold P, from which has been removed the cross tie member Q, is transported onto the returning device 16 by means of drive rollers 44, as has been described earlier, after which the mold P is transported transversely onto the end of the mold assembly line 11.

More specifically, with the returning device as shown in FIGS. 9 and 10, two mounting supports 72 consisting of roller conveyors are provided in the front and rear of the returning device 16, respectively, in the lowered position of the ascending and descending portion 41 of the transportation path 18, while a return roller conveyor 73 is provided in a space defined between the aforesaid two spaced mounting supports 72 as well as in a space defined in the line 11, the aforesaid former space being located in corresonding position to the aforesaid latter space. The return roller conveyor 73 bridges the gap between the upper line 11 and the lower mounting support 72 and is journalled at its end adjacent the line 11. As shown in FIG. 11, the lower mounting support 72 is at a lower level than the line 11 and the conveyor 73 extends downwardly from the line 11 to the mounting support 72. However, by means of the vertical air cylinder 74 which is located midway but immediately below the conveyor 73, the forward end of the conveyor (the end adjacent the mounting support 72) can be raised to provide a downward incline towards the line 11. The mold P is then fed down the inclined conveyor 73. Stoppers 75 are provided at the ends of the conveyor 73 for stopping movement of the mold P. A stopper (not shown) is provided on the forward edge of the mounting support 72, whereby the mold P transported onto the aforesaid mounting support may be stopped, and the leg plates 25 extending from the center of the bottom surface of the mold P may be positioned on the forward portion of the return roller conveyor 73.

A limit switch J is located on the mounting support 72 of the returning device 16 in the vicinity of the stopper, and adapted to sense the arrival of the mold P to actuate the air cylinder 74, thus causing the movable stopper 50 to project in the front of ascending and descending portion 41, while causing the ascending and descending portion 41 to ascend to its home position. The mold P is supported on the return roller conveyor 73 on its leg plates 25 to be thereby transported transversely onto the line 11. Shown at 75 are stoppers provided on the opposite ends of the return roller conveyor for stopping the mold P by the abutment on the connecting plate of the leg plates 25 of the mold P. On the other hand, a limit switch K is provided on the line 11 in the vicinity of the stopper 75 on the return roller conveyor 73, the aforesaid stopper 75 being positioned on the side of line 11. The limit switch K is adapted to sense the mold P which has been transported onto the line 11 transversely, to thereby cause the air cylinder 74 to be actuated in the reversed manner, thereby returning the return roller conveyor 73 to its home position. Shown at 76 is a drive roller provided on the line 11 in a position close to the assembly starting position of the line 11.

According to the returning device 16, the mold P which has been transported on the transportation path in the longitudinal direction thereof is transported from the ascending and descending portion 41 to the mounting support 72, in line with the transportation of the cross tie member Q from the mold P to the finishing line 17, and then sensed by the limit switch J, then transported transversely by way of the return roller conveyor 73 onto the line 11, and then transported in the arrow direction by means of the drive roller 76 which rotates in the counterclockwise direction as viewed in the drawing.

In this embodiment, description has been given of the cross tie member Q. However, the apparatus according to the present invention may be applied to an elongated concrete member having a cross sectional shape similar to that of the cross tie member Q. In this embodiment, only the ascending and descending portion 41 may descend, but the clamps may be moved upwards, instead. In this case, the ascending and descending portion 41 may be stopped or lowered.

As is apparent from the foregoing description, the present invention presents the advantages enumerated below:

1. Since the mold P is of an inverted trapezoid shape in its cross section, with the top surface being open and with the end plates being removable, the elongated concrete member molded in this mold may be readily removed from the mold by lowering the mold, with the concrete member being held at its longitudinally opposite ends. In addition, the concrete member may be transported transversely, positively and readily and may be turned upside down during the above transverse transportation. The elongated concrete member, which has been supported from under after the transverse transportation, is brought into a stable condition which is suited for direct transportation to the finishing step due to its release from being held in the longitudinal direction. In addition, the direction of the concrete member being transported transversely may be selected optionally, so that various modes of productions of the elongated concrete members may be effected. Accordingly, this automatic concrete-member removing method according to the present invention is particularly effective in the automation of the elongated concrete members.

2. Since the clamps are suspended from the crane located above the ascending and descending portion on the transportation path but at a given angle to the transportation path, and since the above clamps are well adapted to clamp in its longitudinal direction the mold of an inverted trapezoid cross section, the elongated concrete member may be removed from the mold readily and positively, only due to the relative movement of the clamps to that of ascending and descending portion, only if the end plates of the mold have been removed. In addition, since the mounting means is provided immediately below the stop position of the transverse transportation of the elongated concrete member by means of the crane, the elongated concrete member may be received positively readily due to the adjustment of the mounting means at the time of the clamps being released.

Accordingly, the automatic concrete member removing device according to the present invention is highly effective in practicing the aforesaid concrete member removing method incorporated in the present invention.

I claim:

1. An apparatus for producing an elongated concrete member, comprising means for placing concrete in molds, a curing area for accommodating molds containing concrete while the concrete is cured, a concrete member removing device for removing concrete members from molds after the concrete has been cured, and transportation means defining:

an elongated mold assembly line, a bank line, and a concrete placing line provided with said means for placing concrete in molds, the mold assembly line, the bank line and the concrete placing line being connected in U-shaped configuration;

a concrete member removing line disposed between said concrete placing line and said mold assembly line, which three lines are disposed parallel to each other, said concrete placing line and said concrete member removing line having said curing area therebetween, and said concrete member removing line being provided with said concrete member removing device;

a returning line extending from the concrete member removing line to said mold assembly line for returning molds after use to said mold assembly line; and a finishing line extending from the concrete member removing line for finishing the concrete members removed from said molds, whereby said molds can be transported longitudinally through said concrete placing line, said concrete member removing line and said mold assembly line, and transversely through said bank line and said returning line, which two lines are disposed parallel to each other, and wherein said concrete member removing device comprises: means for raising and lowering a portion of the transportation means constituting the concrete member removing line; first securing means for holding a mold against upward movement relative to said portion of the transportation means when the mold is positioned on said portion of the transportation means; an overhead crane mounted to travel along a path which extends transversely of the concrete member removing line between a first position, in which the crane is above said portion of the transportation means, and a second position, in which the crane is above an end portion of the finishing line; and second securing means carried by the crane for holding a concrete member against downward movement relative to the crane when the concrete member is secured by the second securing means, whereby a concrete member can be removed from a mold by positioning the mold containing the concrete member at said portion of the transportation means so that the mold is held by the first securing means, bringing the crane to said first position, operating said second securing means to hold the concrete member, lowering said portion of the transportation means to separate the mold from the concrete member, moving the crane to said second position, and operating the second securing means to release the concrete member.

2. An apparatus for producing an elongated concrete member, as forth in claim 1, in combination with a plurality of molds for use in the apparatus wherein each said mold is of an elongated box form and has an open top surface and removable end plates; said mold has a mold body of an inverted trapezoid cross section; supporting plates are provided at the longitudinally opposite ends of said mold body in surrounding relation to the outer surfaces of said mold body; standard horizontal supports are provided on the top surfaces of said supporting plates in projecting relation; standard horizontal planes are provided in the lower end surfaces of said supporting plates to define cutaway portions therein; two longitudinal leg plates extend in parallel from the bottom of said mold body for reinforcing the longitudinal rigidity of said mold body; and two transverse leg plates are provided in parallel in the mid portion of the bottom of said mold body, said transverse leg plates extending through the longitudinal leg plates and extending in the widthwise direction of said mold body.

3. An apparatus for producing an elongated concrete member, as set forth in claim 1 wherein the concrete placing line is provided with a concrete vibrating and stamping device which comprises a plurality of parallel receiving supports provided on the top surface of a vibrating base in a longitudinally spaced relation, said vibrating base is supported on a buffer means, with the top surfaces of said respective receiving supports being maintained horizontally on the level with the transporting surface of the concrete placing line; feed rollers of elliptic cross sections rotatably inserted between said adjoining receiving supports, the longer radius and the shorter radius of said feed rollers being longer and shorter respectively than the height from the axis of said rollers to said top surface of said receiving supports.

4. An apparatus for producing an elongate concrete member, as set forth in claim 1, wherein there is provided at said end portion of the finishing line a rotating means consisting of a lower cylindrical body, an upper cylindrical body having a top portion for receiving a concrete member released by the second securing means, said upper cylindrical body being arranged to ascend and descend according to a vertical cylinder fitted in said lower cylindrical body, and rollers provided at the lower inner circumferential surface of said upper cylindrical body and fitted in guide grooves provided in the outer circumferential surface of said lower cylindrical body, whereby said rotating means may be rotated through a given angle according to the ascending and descending movements of said upper cylindrical body due to the guiding action of said rollers and said guide grooves.

5. An apparatus for producing an elongated concrete member, as set forth in claim 4, wherein the lower portions of said guide grooves extend vertically in a manner that said rotating means may linearly descend after its rotation through a given angle.

6. An apparatus for producing an elongated concrete member, as set forth in claim 4, wherein there are provided a pair of slat conveyors on the opposite sides of said rotating means for supporting said elongated concrete member at its opposite ends, said conveyors being adapted to transport said concrete member to said finishing line.

7. An apparatus for producing an elongated concrete member, as set forth in claim 1, wherein said transportation means comprises a pair of left and righthand chains which are mutually connected by means of a plurality of link shafts and move in the longitudinally transporting direction of molds, and a plurality of rollers which are rotatably provided on said link shafts respectively between said chains, thereby forming the transporting surface for said molds.

8. An apparatus for producing an elongated concrete member, as set forth in claim 1, wherein said transportation means are provided with a movable stopper between said portion of the transportation means and the rest of the concrete member removing line for controlling said mold which is being transported to said portion of the transportation means.

* * * * *